US012601478B2

(12) United States Patent
Shiraha et al.

(10) Patent No.: US 12,601,478 B2
(45) Date of Patent: Apr. 14, 2026

(54) COMBUSTION APPARATUS

(71) Applicant: RINNAI CORPORATION, Aichi (JP)

(72) Inventors: Yusuke Shiraha, Aichi (JP); Masaru Takeuchi, Aichi (JP)

(73) Assignee: Rinnai Corporation, Aichi (JP)

( * ) Notice: Subject to any disclaimer, the term of this patent is extended or adjusted under 35 U.S.C. 154(b) by 431 days.

(21) Appl. No.: 18/340,307

(22) Filed: Jun. 23, 2023

(65) Prior Publication Data

US 2024/0060640 A1 Feb. 22, 2024

(30) Foreign Application Priority Data

Aug. 22, 2022 (JP) ..... 2022-131512

(51) Int. Cl.
*F23D 14/70* (2006.01)

(52) U.S. Cl.
CPC ..... *F23D 14/70* (2013.01)

(58) Field of Classification Search
CPC ..... F23D 14/70; F23D 14/02
USPC ..... 431/8
See application file for complete search history.

(56) References Cited

U.S. PATENT DOCUMENTS 4,162,888 A * 7/1979 Weishaupt ..... F23D 11/40 431/189
10,508,829 B2 12/2019 Ojiro
10,746,397 B1 * 8/2020 Ono ..... F23D 14/78
2017/0350617 A1 * 12/2017 Ojiro ..... F23N 5/12
2019/0078776 A1 * 3/2019 Ojiro ..... F24H 9/0015
2019/0186785 A1 * 6/2019 Ono ..... F24H 9/02

FOREIGN PATENT DOCUMENTS

JP 2017078526 A 4/2017

* cited by examiner

*Primary Examiner* — Avinash A Savani
(74) *Attorney, Agent, or Firm* — Future IP LLC; Tomoko Nakajima

(57) ABSTRACT

In a combustion apparatus that includes a burner constituted by a burner body, an inside of which an air-fuel mixture is supplied to and one surface of which is made into an open surface, and a combustion plate covering the open surface of the burner body, and a combustion box enclosing a combustion space of the air-fuel mixture ejecting from the combustion plate, an offset part that is positioned at a portion which is away from the swelling part in an inflow direction of the air-fuel mixture to the inner chamber and does not oppose to a tip part(s) of the ignition electrode(s) through the combustion plate is provided with the opposite wall of the burner body and the offset part offsets to a combustion-plate side so that a distance between the offset part and the combustion plate becomes shorter than that between the combustion plate and a general part of the opposite wall except the swelling part and the offset part.

2 Claims, 6 Drawing Sheets

COMBUSTION APPARATUS

TECHNICAL FIELD

The invention relates to a combustion apparatus that includes a burner constituted by a burner body, an inside of which an air-fuel mixture is supplied to and one surface of which is made into an open surface, and a combustion plate covering the open surface of the burner body, and a combustion box enclosing a combustion space of the air-fuel mixture ejecting from the combustion plate.

BACKGROUND ART

Conventionally, as this kind of the combustion apparatus, there has been known the combustion apparatus in which an ignition electrode faced to the combustion plate is mounted on a predetermined side plate of the combustion box and a swelling part, an inside of which becomes an inflow chamber of the air-fuel mixture and which swells in a direction away from the combustion plate, is provided with a part of an opposite wall of the burner body, which opposes to the combustion plate at a distance (See Patent document No. 1, for example). In this combustion apparatus, on a premise that a direction from the predetermined side plate of the combustion box to a side plate, opposite to the predetermined side plate, of the combustion box is a predetermined direction, the air-fuel mixture is configured to flow in the inflow chamber with a direction component along the predetermined direction.

REFERENCE

Patent document No. 1: JPA 2017-078526

SUMMARY OF INVENTION

Technical Problem

In the above-mentioned combustion apparatus, the air-fuel mixture flowing from the inflow chamber to a space between the opposite wall of the burner body and the combustion plate is liable to go forward in an inflow direction of the air-fuel mixture. Then, since the inflow direction of the air-fuel mixture has a direction component going from the side plate of the combustion box, on which the ignition electrode is mounted, to the side plate opposite to the side plate previously mentioned, the air-fuel mixture is not sufficiently distributed to a part of the combustion plate opposite to a tip part of the ignition electrode, at which spark discharge occurs. As a result, an ignition performance is sometimes deteriorated.

In the light of the above-mentioned problem, an object of the invention is to provide a combustion apparatus that can improve the ignition performance.

Solution to Problem

In order to accomplish the object, the invention presupposes a combustion apparatus that includes a burner constituted by a burner body, an inside of which an air-fuel mixture is supplied to and one surface of which is made into an open surface, and a combustion plate covering the open surface of the burner body; and a combustion box enclosing a combustion space of the air-fuel mixture ejecting from the combustion plate, wherein an ignition electrode(s) faced to the combustion plate is mounted on a predetermined side plate of the combustion box and a swelling part, an inside of which becomes an inflow chamber of the air-fuel mixture and which swells in a direction away from the combustion plate, is provided with a part of an opposite wall of the burner body, which opposes to the combustion plate at a distance, and wherein on a premise that a direction from the predetermined side plate of the combustion box to a side plate, opposite to the predetermined side plate, of the combustion box is a predetermined direction, the air-fuel mixture is configured to flow in the inflow chamber with a direction component to the predetermined direction. In the combustion apparatus, an offset part that is positioned at a portion which is away from the swelling part in an inflow direction of the air-fuel mixture to the inflow chamber and does not oppose to a tip part(s) of the ignition electrode(s) through the combustion plate is provided with the opposite wall of the burner body and the offset part offsets to a combustion-plate side so that a distance between the offset part and the combustion plate becomes shorter than that between the combustion plate and a general part of the opposite wall except the swelling part and the offset part.

According to the invention, a flow resistance of a space between the opposite wall of the burner and the combustion plate increases at the offset part that is away from the swelling chamber in the inflow direction of the air-fuel mixture to the inflow chamber. Therefore, a flow of the air-fuel mixture forward in the inflow direction from the inflow chamber is moderately suppressed. According to this, the air-fuel mixture is sufficiently distributed to the part of the combustion plate which is opposite to the tip part(s) of the ignition electrode(s), at which spark discharge occurs, and an ignition performance is improved.

In the invention, it is desirable that an inclining part, which is positioned between the swelling part and the offset part and a distance from the combustion plate of which continuously decreases toward the offset part, is provided with the opposite wall. Here, if a step is provided at an end portion of the offset part near the swelling part, in a state where a supply amount of the air-fuel mixture to the burner body is large, due to pressure loss at the step, there is possibility that the air-fuel mixture is not sufficiently distributed to a space between the offset part and the combustion plate. By provision of the inclining part as above-mentioned, the pressure loss decreases and even in the state where the supply amount of the air-fuel mixture to the burner body is large, the air-fuel mixture can be sufficiently distributed to the space between the offset part and the combustion plate.

DESCRIPTION OF EMBODIMENTS

Figure 1:
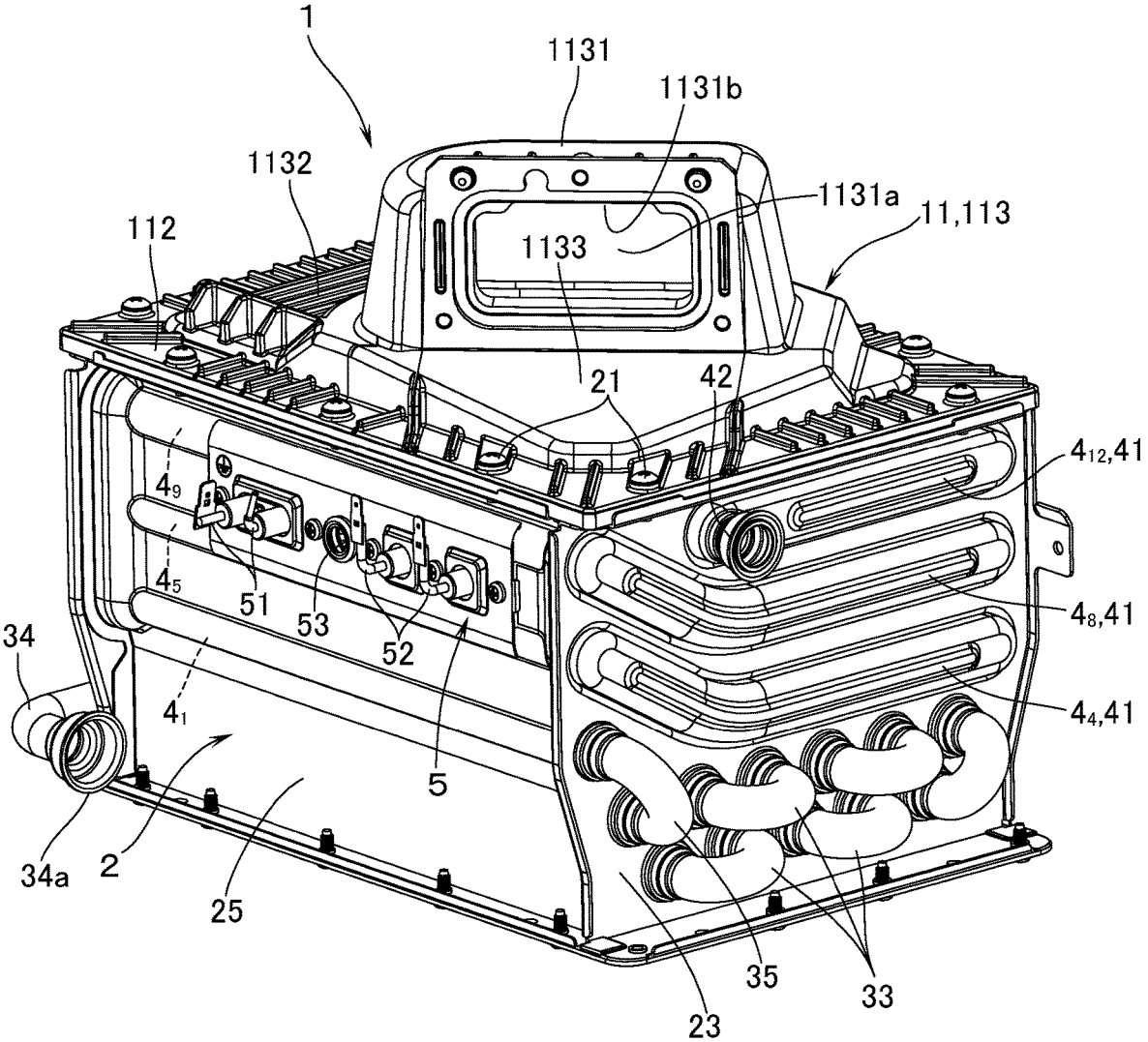
FIG. 1 is a perspective view of a combustion apparatus of an embodiment of the invention.

A combustion apparatus, which is shown in FIGS. 1 through 5, of an embodiment of the invention includes a totally-aerated burner 1 that is constituted by a burner body 11, an inside of which an air-fuel mixture (a mixed gas of a fuel gas and a primary air) is supplied to and a lower surface as one surface of which is made into an open surface 111, and a combustion plate 12 covering the open surface 111 of the burner body 11; and a combustion box 2 enclosing a combustion space of the air-fuel mixture ejecting from the combustion plate 12. At an upper end of the combustion box 2, a box flange part 22 that is fitted to a body flange part 112 enclosing the open surface 111 of the burner body 11 by a screw 21 is provided. In the combustion box 2, a heat exchanger 3 for hot-water supply is housed.

The heat exchanger 3 is constituted by a fin-tube type heat exchanger that includes a plurality of fins 31 and a plurality of heat-absorbing tubes 32 piercing the fins 31. At an outside of each of side plates 23, 24 of one side and the other side in lateral direction of the combustion box 2, a plurality of U-shaped vent pipes 33 connecting adjacent two heat-absorbing tubes 32, 32 are provided and all of the heat-absorbing tubes 32 are connected in series. A pipe 34 with which a water inlet 34*a* is provided at an end portion is connected to the heat-absorbing tube 32 at an upstream end.

Figure 2:
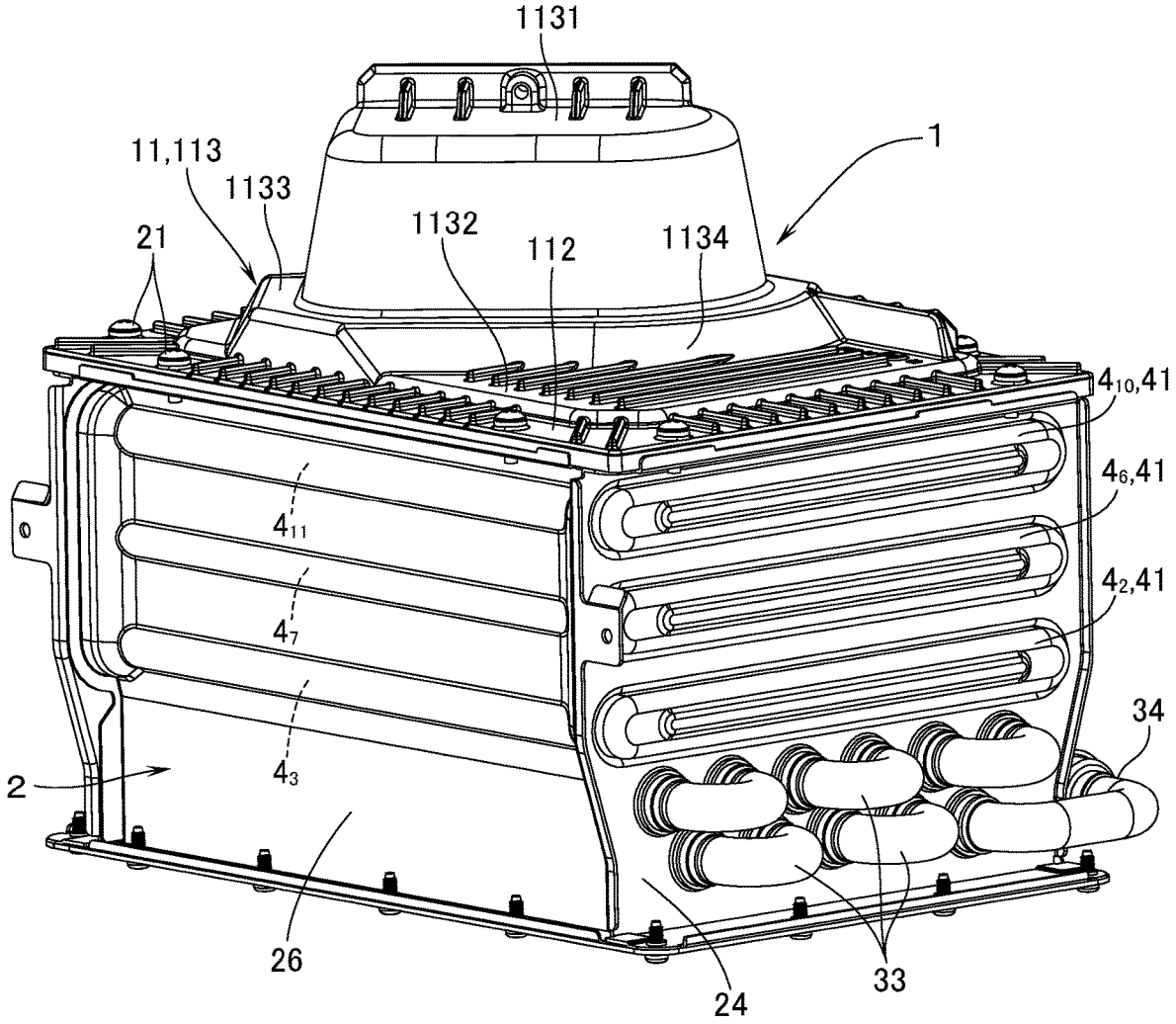
FIG. 2 is a perspective view of the combustion apparatus seen from an opposite side with respect to FIG. 1.
Figure 4:
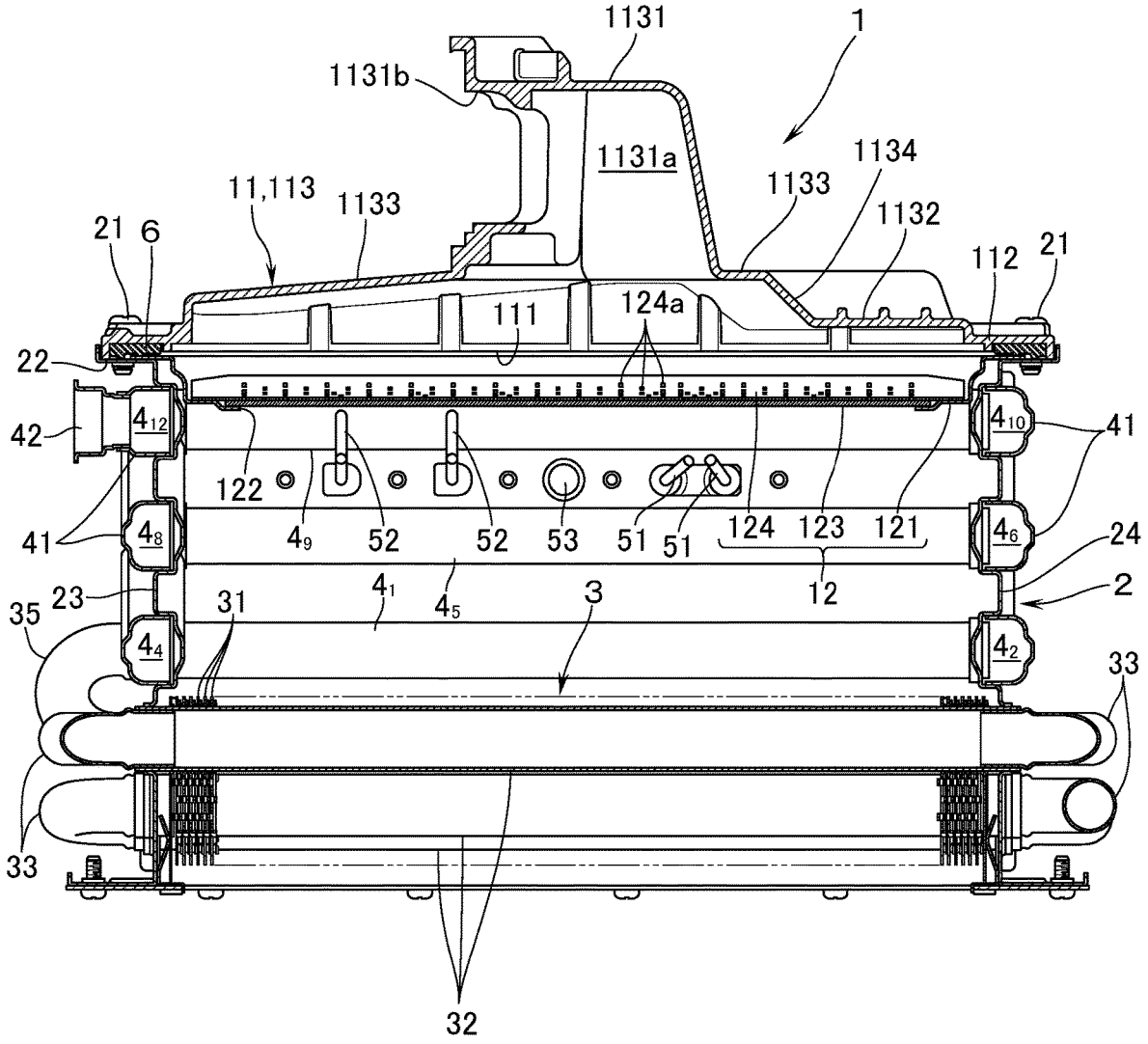
FIG. 4 is a sectional view that is cut off along a IV-IV line of FIG. 3.
Figure 5:
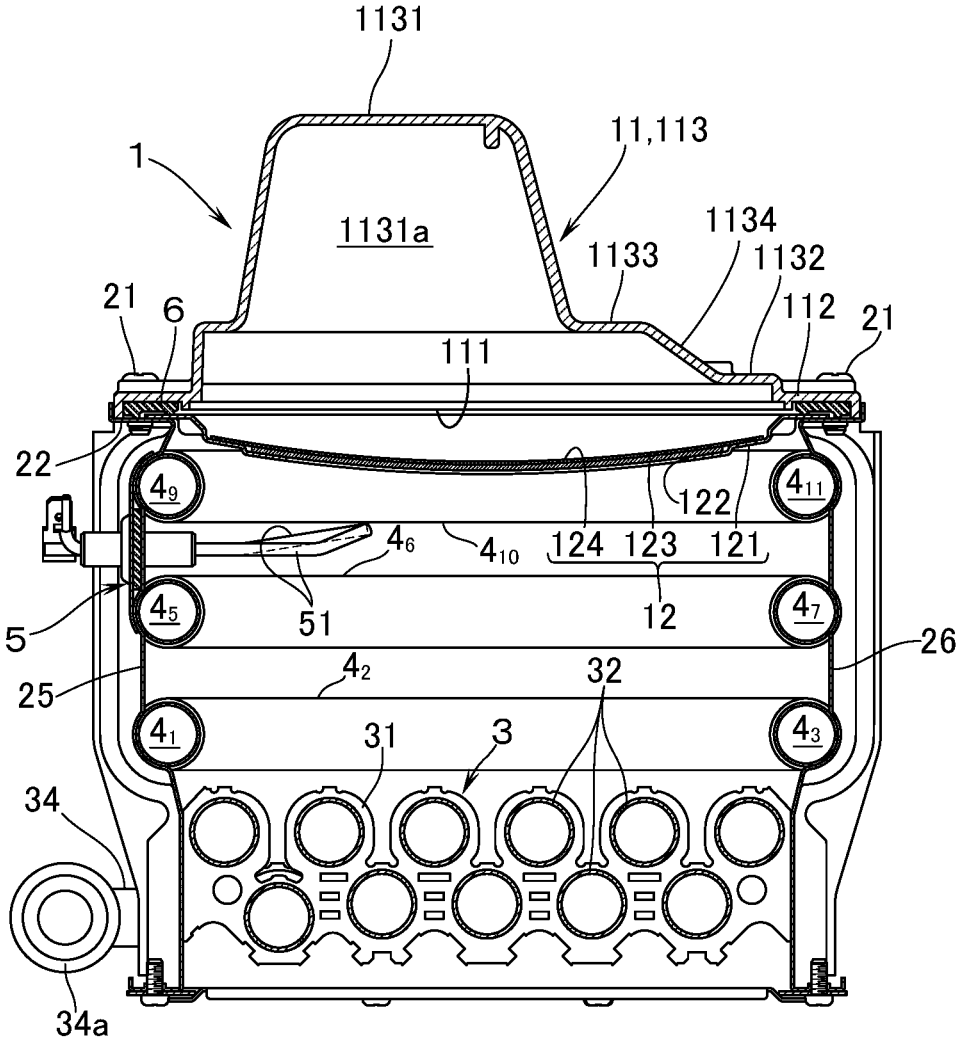
FIG. 5 is a sectional view that is cut off along a V-V line of FIG. 3.

Referring to FIG. 5, at an inside of a part of a side plate 25 of a front side of the combustion box 2, which is positioned above the heat exchanger 3, three water passages, i.e., a first water passage $\mathbf{4}_1$, a fifth water passage $\mathbf{4}_5$, and a ninth water passage $\mathbf{4}_9$, which consist of a pipe, are disposed in sequence from below so as to come into contact with the side plate 25. Also, at an inside of a part of a side plate 26 of a rear side of the combustion box 2, which is positioned above the heat exchanger 3, three water passages, i.e., a third water passage 43, a seventh water passage 47, and an eleventh water passage 4*ii*, which consist of a pipe, are disposed in sequence from below so as to come into contact with the side plate 26. Additionally, at an outside of the side plate 23 at one side in the lateral direction of the combustion box 2, as shown in FIGS. 1, 4, a connecting pipe 35 connecting the heat-absorbing tube 32 at a downstream end of the heat exchanger 3 to the first water passage $\mathbf{4}_1$ is provided and at a part of the side plate 23, which is positioned above the heat exchanger 3, a fourth water passage $\mathbf{4}_4$ connecting the third water passage 43 and the fifth water passage $\mathbf{4}_5$, an eighth water passage $\mathbf{4}_8$ connecting the seventh water passage $\mathbf{4}_7$ and the nineth water passage $\mathbf{4}_9$, and a twelfth water passage $\mathbf{4}_{12}$ connected to the eleventh water passage $\mathbf{4}_{11}$ are provided. Further, with the side plate 24 of the other side in the lateral direction of the combustion box 2, as shown in FIGS. 2, 4, a second water passage $\mathbf{4}_2$ connecting the first water passage $\mathbf{4}_1$ and the third water passage $\mathbf{4}_3$, a sixth water passage $\mathbf{4}_6$ connecting the fifth water passage $\mathbf{4}_5$ and the seventh water passage $\mathbf{4}_7$, and a tenth water passage $\mathbf{4}_{10}$ connecting the nineth water passage $\mathbf{4}_9$ and the eleventh water passage $\mathbf{4}_{11}$, each of which is positioned above the heat exchanger 3, are provided. Each of the second, sixth, and tenth water passages $\mathbf{4}_2$, $\mathbf{4}_6$, $\mathbf{4}_{10}$, and each of the fourth, eighth, and twelfth water passages $\mathbf{4}_4$, $\mathbf{4}_8$, $\mathbf{4}_{12}$ are constituted by cavities inward in the lateral direction, which are formed at each of the side plates 24, 23, and lids 41 fitted to the outside surface of each of the side plates 24, 23 so as to cover the cavities. Water heated in the heat exchanger 3 flows in the first water passage $\mathbf{4}_1$ through the twelfth water passage $\mathbf{4}_{12}$ in sequence and are supplied from a hot water outlet $\mathbf{4}_2$ provided with an end portion of the twelfth water passage $\mathbf{4}_{12}$ to a hot water pipe, not shown, connecting to the hot water outlet $\mathbf{4}_2$. Then, each of the side plates 23 through 26 of the combustion box 2 are configured to be cooled by water flowing in the first water passage $\mathbf{4}_1$ through the twelfth water passage $\mathbf{4}_{12}$.

Furthermore, on the side plate 25 of the front side of the combustion box 2, electrode parts 5 having a pair of ignition electrodes 51, 51 protruding in the combustion box 12 and facing to the combustion plate 12, and a pair of flame rods 52, 52 are provided. In this connection, one of the ignition electrodes 51, 51 is applied to high voltage and the other is grounded. Spark discharge is performed between tip parts of the ignition electrodes 51, 51 and the air-fuel mixture ejecting from the combustion plate 12 is ignited. Also, with the electrode parts 5, an inspection window 53 through which visual inspect in the combustion box 2 is possible is additionally provided.

Figure 6:
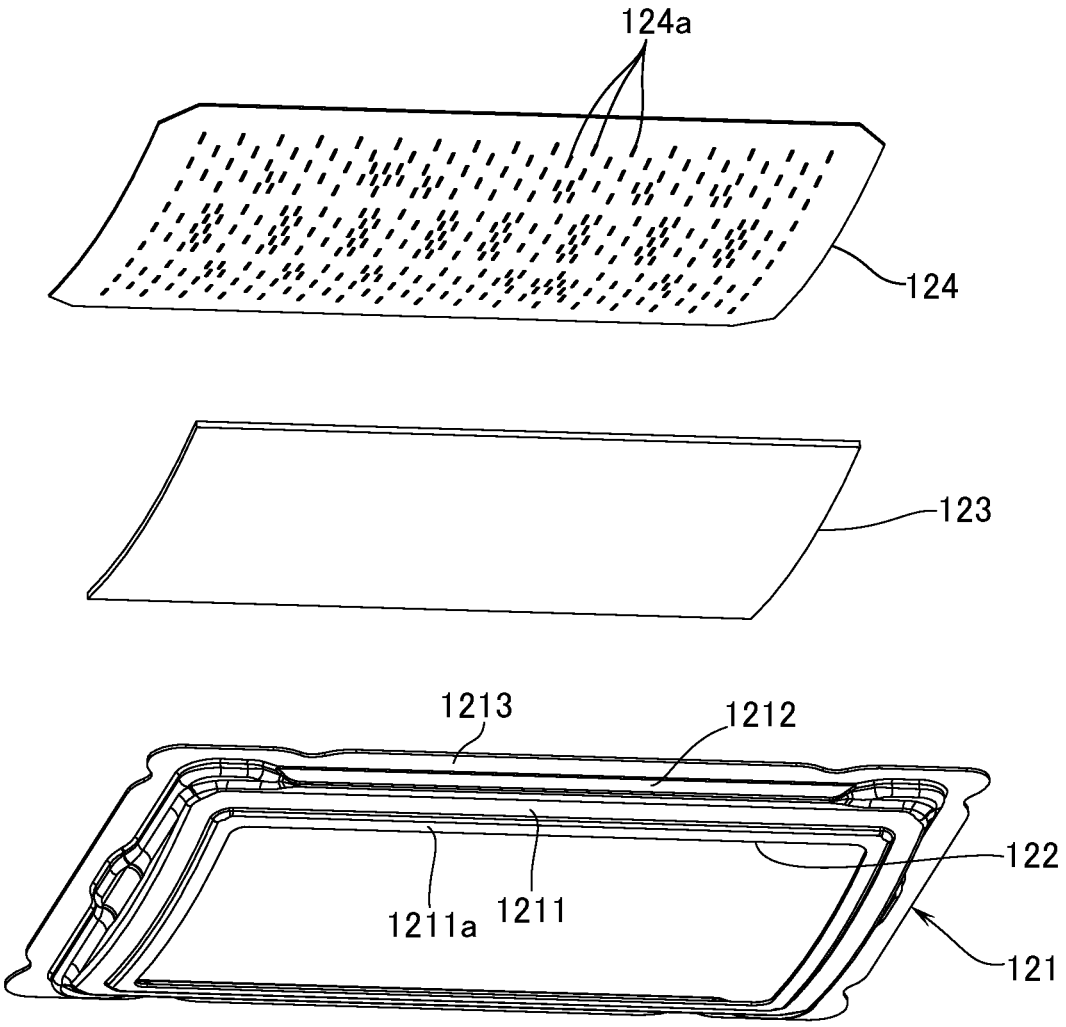
FIG. 6 is a perspective view of a combustion plate of a burner in a decomposed state, which is a component of the combustion apparatus of the embodiment.

Next, detailed explanation regarding the burner 1 will be made. With reference also to FIG. 6, a combustion plate 12 has a burner frame 121 with a shape of a picture frame and an air-fuel mixture permeable body 123 covering an opening 122 enclosed by the burner frame 121 from a burner-body 11 side (from above), through which the air-fuel mixture permeates. The air-fuel mixture permeable body 123 can be constituted by woven or nonwoven fabric of a heat-resistant fiber such as a metal fiber and the like, or a porous sintered compact and the like. On a rear surface (upper surface), which is a surface of an upstream side in a flowing direction of the air-fuel mixture, of the air-fuel mixture permeable body 123, a distribution plate 124 in which a plurality of distribution holes 124*a* are opened is overlapped. Then, the air-fuel mixture supplied in the burner body 11 ejects from the opening 122 through the distribution holes 124*a* and the air-fuel mixture permeable body 123, and totally aerated combustion (combustion unnecessary for secondary air) is performed. In this connection, a sectional shape along a front-to-back direction of the opening 122, as shown in FIG. 5, curves into an arcuate shape and the sectional shapes of the air-fuel mixture permeable body 123 and the distribution plate 124 similarly curves into the arcuate shape along the front-to-back direction.

The burner frame 121 has an opening peripheral edge part 1211 around the opening 122, a side plate part 1212 bending from the opening peripheral edge part 1211 to the burner-body 11 side (upward), and a frame flange part 1213 outwardly extending from an upper end of the side plate part 1212. With a portion of the opening peripheral edge part 1211, which is close to an inner circumference, a squeezed part 1211*a* that comes down by one step is provided. A peripheral edge part of the air-fuel mixture permeable body 123 is overlapped on the squeezed part 1211*a*. In a state where the distribution plate 124 is overlapped on the rear surface of the air-fuel mixture permeable body 123, the combustion plate 12 is assembled by spot-welding a peripheral part of the distribution plate 124 to a portion of the opening peripheral part 1211 of an outside of the squeezed part 1211*a* at a constant distance. The frame flange part 1213 is sandwiched between the body flange part 112 and the box flange part 22. Additionally, a packing 6 is interposed between the frame flange part 1213 and the body flange part 112, and a sealing property between the burner body 11 and the combustion plate 12 is secured. In this connection, the packing 6 has a portion outwardly extending beyond the frame flange part 1213. This portion is interposed between the body flange part 112 and the box flange part 22, and the sealing property between the body flange part 112 and the box flange part 22 is secured.

Figure 3:
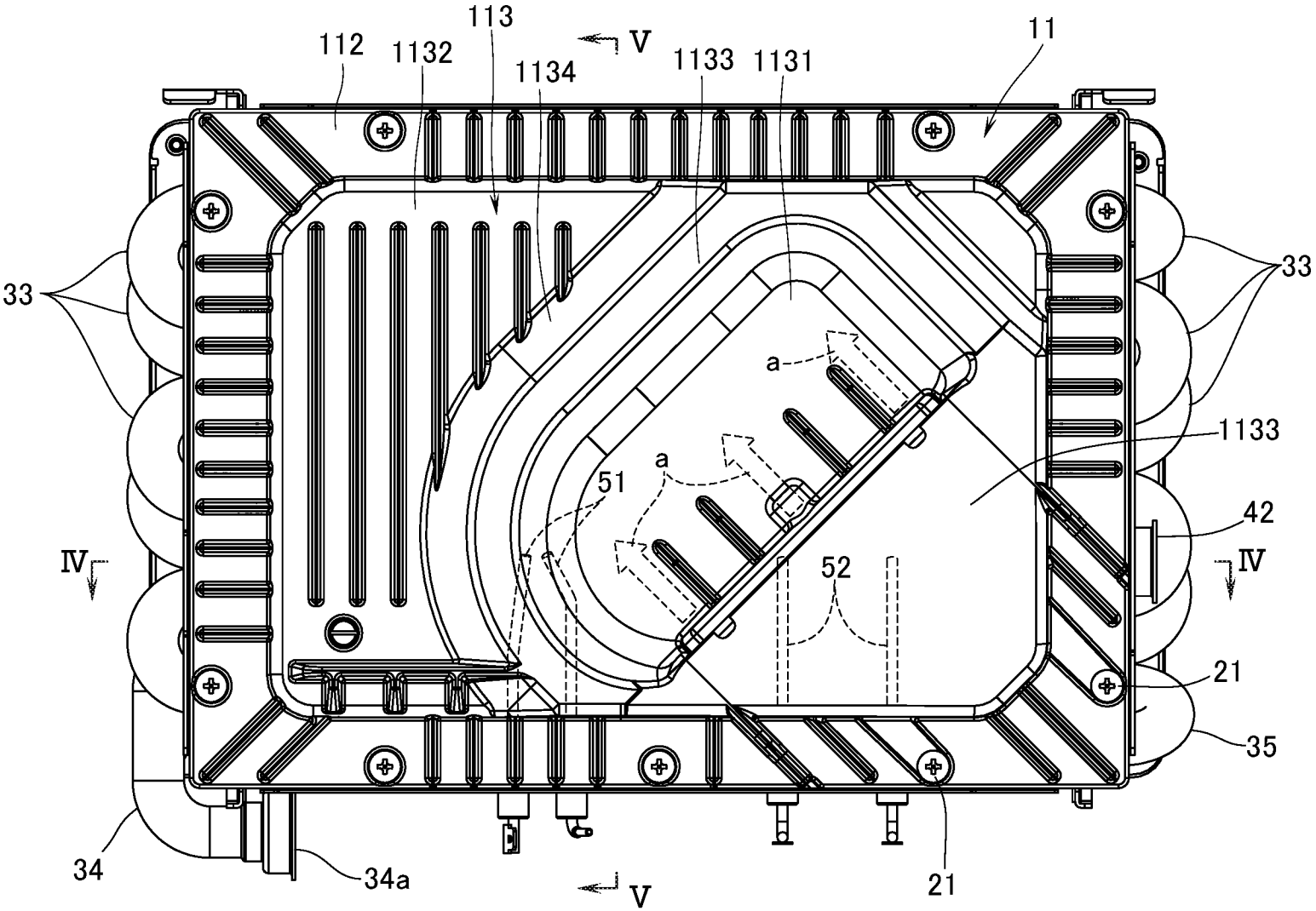
FIG. 3 is a plan view of the combustion apparatus of the embodiment.

The burner body 11 has a swelling part 1131 that is provided with a part of an opposite wall 113 opposite to the combustion plate 12 at a distance and swells upward, as a direction away from the combustion plate 12. An inside of the swelling part 1131 is made into an inflow chamber 1131*a* of the air-fuel mixture. Additionally, in the swelling part 1131, on a premise that one side in lateral direction of the combustion box 2, at which the side plate 23 exists, is defined to be a right side, an inflow port 1131*b* is opened diagonally in front and rightward. Further, the air-fuel mixture from the fan, not shown, is configured to flow in the inflow chamber 1131*a* through the inflow port 1131*b* with a rear direction component as a direction from the side plate 25 disposed at a front side of the combustion box 2, on which the electrode parts 5, i.e., the ignition electrodes 51, 51, are mounted, to the side plate 26 disposed at a rear side and opposite to the side plate 25. Specifically, the air-fuel mixture flows diagonally in rear and leftward and the flowing direction of the air-fuel mixture is represented by an arrow "a" as shown in FIG. 3.

In this case, the air-fuel mixture flowing to a space between the opposite wall 113 of the burner body 11 and the combustion plate 12 is liable to go forward in an inflow direction of the air-fuel mixture from the inflow chamber 1131*a*. Further, since the inflow direction of the air-fuel mixture has a direction component going from the side plate 25 of the front side of the combustion box 2, on which the ignition electrode 51 is mounted, to the side plate 26 of the rear side opposite to the side plate 25, the air-fuel mixture flowing in the inflow direction as previously mentioned is not sufficiently distributed to a part of the combustion plate 12 opposite to tip parts of the ignition electrodes 51, 51, at which spark discharge occurs. As a result, there is a possibility that an ignition performance is sometimes deteriorated.

Then, in the embodiment, with the opposite wall 113 of the burner body 11, an offset part 1132 that is positioned at a portion which is away from the swelling part 1131 in the inflow direction (diagonally in rear and leftward) of the air-fuel mixture to the inflow chamber 1131*a* is provided. The offset part 1132 offsets to the combustion plate 12-side so that a distance between the offset part 1132 and the combustion plate 12 becomes shorter than that between the combustion plate 12 and a general part 1133 of the opposite wall 113 except the swelling part 1131 and the offset part 1132. In this connection, in the embodiment, a part of the opposite wall 113 opposite to the tip parts of the ignition electrodes 51, 51 through the combustion plate 12, i.e., a part of the opposite wall 113 positioned just above the tip parts of the ignition electrodes 51, 51, is a part of the swelling wall 1131. Therefore, the offset part 1132 is positioned at a portion that does not oppose to the tip parts of the ignition electrodes 51, 51 through the combustion plate 12. Additionally, in the embodiment, the offset part 1132 is provided to range to a part of the opposite wall 113, which is separated leftward from the swelling part 113.

According to the above-mentioned constitution, a flow resistance of the space between the opposite wall 113 of the burner body 11 and combustion plate 12 becomes large at the offset part 1132 that is away from the swelling part 1131 in the inflow direction of the air-fuel mixture to the inflow chamber 1131*a*. Therefore, a flow of the air-fuel mixture, which goes forward in the inflow direction from the inflow chamber 1131*a*, is moderately suppressed. Due to this, the air-fuel mixture is sufficiently distributed to even a part of the combustion plate 12 opposite to the tip parts of the ignition electrodes 51, 51, at which the spark discharge occurs, and the ignition property is improved.

In this connection, if there is a step that exists at an end portion of the offset part 1132, which comes close to the swelling part 1131, in a state where a supply amount of the air-fuel mixture to the burner body 11 is large, due to pressure loss at the step, there is a possibility that the air-fuel mixture will not be sufficiently distributed to the space between the offset part 1132 and the combustion plate 12.

Then, in the embodiment, as shown in FIGS. 4, 5, with the opposite wall 113 of the burner body 11, an inclining part 1134 that is positioned between the swelling part 1131 and the offset part 1132 and of which a distance from the combustion plate 12 continuously decreases toward the offset part 1132 is provided. Due to provision of the inclining part 1134, the pressure loss decreases. Therefore, even at the state where an amount of the air-fuel mixture to the burner body 11 is large, the air-fuel mixture can be sufficiently distributed to the space between the offset part 1132 and the combustion plate 12.

In this connection, in the embodiment, the general part 1133 adjacent to the swelling part 113 is provided between the swelling part 1131 and offset part 1132 and the inclining part 1134 is provided between the general part 1133 and the offset part 1132. It is also possible that only the inclining part 1134 is provided between the swelling part 1131 and the offset part 1132 without provision of the general part 1133.

Though the embodiment of the invention is explained with reference to the drawings in the above, the invention is not limited to the embodiment. For example, the part of the opposite wall 113 that is positioned just above the tip parts of the ignition electrodes 51, 51 may be a part of the general part 1133 adjacent to the swelling part 1131, which is different from the above-mentioned embodiment. Further, in the above-mentioned embodiment, though a pair of the ignition electrodes 51, 51 are provided, only one ignition electrode is provided and the spark discharge may be performed between a tip part of the ignition electrode and the combustion plate. Furthermore, in the above-mentioned embodiment, though the lower surface of the burner body 11 is made into the open surface 111, the invention is similarly applicable to a combustion apparatus in which an upper surface of the burner body 11 is made into the open surface 111 and the combustion box 2 is disposed over the burner 1.

EXPLANATION OF SYMBOLS

1 Burner
11 Burner body
111 Open surface
113 Opposite wall
1131 Swelling part
1131*a* Inflow chamber
1132 Offset part
1133 General part
1134 Inclining part
12 Combustion plate
2 Combustion plate
25 Side plate of front side (predetermined side plate)
26 Side plate of rear side (side plate opposite to predetermined side plate)
51 Ignition electrode

What is claimed is:

1. A combustion apparatus comprising, a burner constituted by a burner body an inside of which an air-fuel mixture is supplied to and one surface of which is made into an open surface, and a combustion plate covering the open surface of the burner body; and a combustion box enclosing a combustion space of the air-fuel mixture ejecting from the combustion plate, wherein an ignition electrode(s) faced to the combustion plate is mounted on a predetermined side plate of the combustion box and a swelling part, an inside of which becomes an inflow chamber of the air-fuel mixture and which swells in a direction away from the combustion plate, is provided with a part of an opposite wall of the burner body, which opposes to the combustion plate at a distance, and wherein on a premise that a direction from the predetermined side plate of the combustion box to a side plate, opposite to the predetermined side plate, of the combustion box is a predetermined direction, the air-fuel mixture is configured to flow in the inflow chamber with a direction component to the predetermined direction, wherein:

an offset part that is positioned at a portion which is away from the swelling part in an inflow direction of the air-fuel mixture to the inflow chamber and does not oppose to a tip part(s) of the ignition electrode(s) through the combustion plate is provided with the opposite wall of the burner wall and the offset part offsets to a combustion-plate side so that a distance between the offset part and the combustion plate is shorter than that between the combustion plate and a general part of the opposite wall except the swelling part and the offset part.

2. The combustion apparatus as claimed in claim 1, wherein an inclining part, which is positioned between the swelling part and the offset part and a distance from the combustion plate of which continuously decreases toward the offset part, is provided with the opposite wall.

* * * * *